US005609347A

United States Patent [19]

Dressel

[11] Patent Number: 5,609,347

[45] Date of Patent: Mar. 11, 1997

[54] SNOWBOARD BINDINGS WITH RELEASE APPARATUS

[76] Inventor: Donald Dressel, 21610 Beallsville Rd., Barnesville, Md. 20838

[21] Appl. No.: 443,401

[22] Filed: May 17, 1995

[51] Int. Cl.[6] ..... A63C 5/03

[52] U.S. Cl. ..... 280/14.2; 280/611; 280/633; 280/623

[58] Field of Search ..... 280/14.2, 607, 280/611, 617, 619, 622, 623, 633, 634, 637, 804; 24/70 SK; 441/70

[56] References Cited

U.S. PATENT DOCUMENTS

| | | | |
|---|---|---|---|
| 376,055 | 1/1888 | Hopkins et al. | 24/70 SK |
| 3,662,435 | 5/1972 | Allsop . | |
| 3,830,511 | 8/1974 | Unger | 280/634 |
| 4,165,887 | 8/1979 | Bunn, Jr. | 280/637 |
| 4,856,808 | 8/1989 | Longoni . | |
| 4,979,760 | 12/1990 | Derrah | 280/607 |
| 5,029,890 | 7/1991 | Pfaffenbichler et al. . | |
| 5,035,443 | 7/1991 | Kincheloe . | |
| 5,054,807 | 10/1991 | Fauvet | 280/607 |
| 5,094,470 | 3/1992 | Riedel | 280/14.2 |
| 5,190,311 | 3/1993 | Carpenter et al. . | |
| 5,362,087 | 11/1994 | Agid . | |

FOREIGN PATENT DOCUMENTS

| | | | |
|---|---|---|---|
| 2660204 | 10/1991 | France | 280/607 |

*Primary Examiner*—Brian L. Johnson
*Assistant Examiner*—Min Yu
*Attorney, Agent, or Firm*—Law Office of Steven M. Rabin, P.C.

[57] ABSTRACT

A snowboard has a pair of bindings for a person's footwear. Each binding includes a laterally spaced apart independently moveable pair of binding straps and latches that can be engaged in latched positions over the vamp of the footwear for binding the footwear to the snowboard. On each binding, a release strap is connected between the two latches, so that by pulling on the release strap in a direction away from the snowboard's upper surface, forces are applied to actuation members of both latches so as to release both binding straps from their latched positions.

8 Claims, 5 Drawing Sheets

FIG. 7
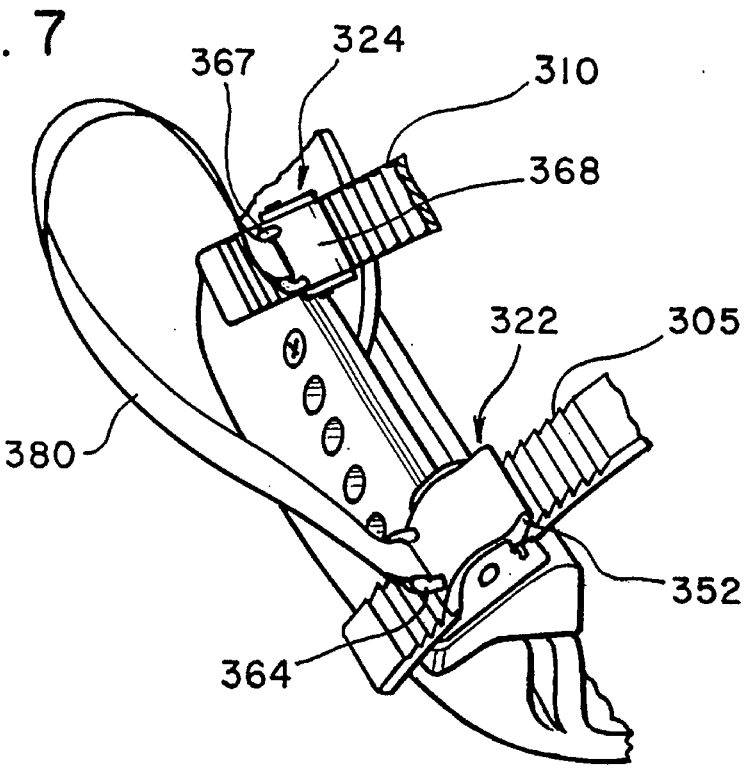
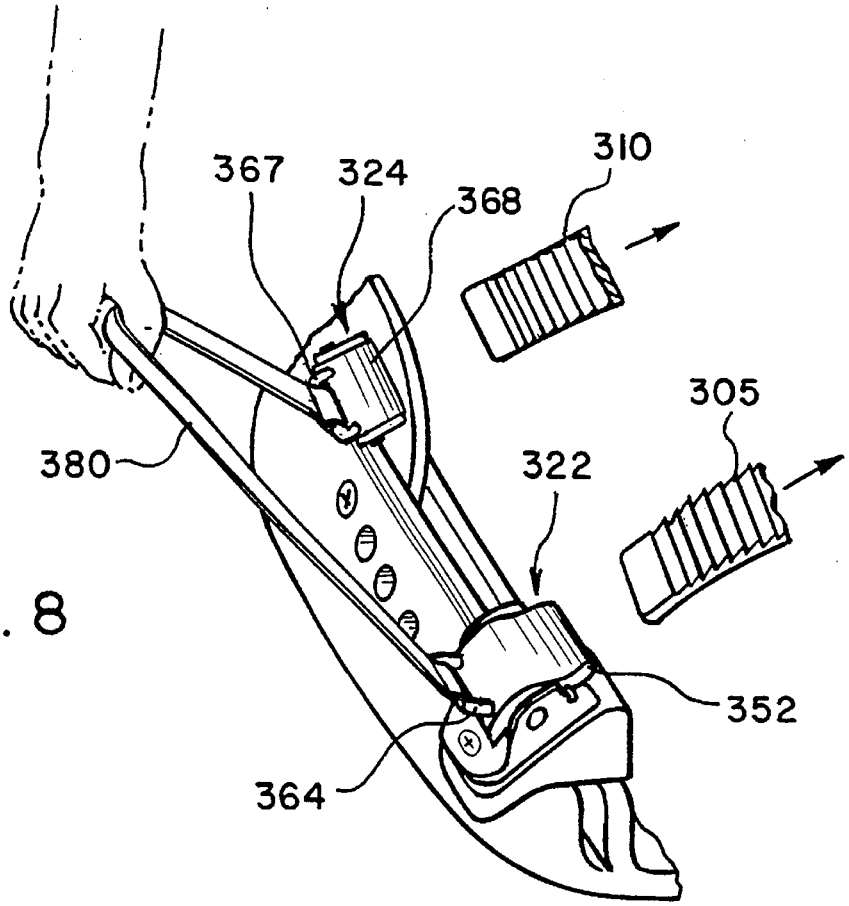
FIG. 8

SNOWBOARD BINDINGS WITH RELEASE APPARATUS

BACKGROUND OF THE INVENTION

1. Field of the Invention

The invention relates to snowboard bindings and more particularly, to an apparatus for manually releasing the bindings.

2. Description of the Related Art

Snowboarding is a sport which has become widely popular in the last several years and is typically engaged in on snow-covered slopes originally designed for downhill skiing. However, snowboarding can be far more dangerous than skiing in some situations. This is because, in contrast to a pair of today's downhill skis (which are independently connected by respective bindings to the skier's ski boots, so as to be independently releasable by a simple pull to a release mechanism with one hand or automatically in the event of a high force impact such as in a fall), today's snowboard has two bindings fixed on a single board that typically will not release from the snowboarder's boots in the event of even a severe impact. Moreover, the bindings on a snowboard can be released only by using both hands to release each of two latches or catch buckles on each binding. This requirement can be exceedingly dangerous in the event that a snowboard becomes lodged under a large amount of snow, such as in the event of an avalanche or if the snowboarder falls while boarding through deep virgin snow. In such a case, it may be difficult for the snowboarder to reach both hands deep into the snow to reach the bindings. The situation is exacerbated by the fact that both feet (on which boots are worn) are held by the bindings to a single snowboard and that snowboards are much wider and heavier than skis. As a result, a snowboard may be impossible to dislodge from under the snow without first releasing the feet therefrom.

The bindings for most snowboards in use and on the market today each have two binding straps for binding the foot to the board, including an instep binding strap and a toe binding strap, each strap with a buckle or latch that must be independently released before the snowboarder's booted foot can be removed from the binding. Such buckles are typically spring-biased toward a closed position in which a serration on the buckle engages between adjacent teeth or serrations on the strap. The buckle typically has an actuation member with a small ribbed surface to be engaged by a finger for holding the buckle in an open position. Thus, even in normal use, snowboard bindings are troublesome to release from the snowboarder's boots. It requires all but the most adept snowboarder to bend, kneel or sit down and apply both hands to manipulate and release the two buckles so that the foot can be lifted away from the board and released from the binding. Moreover, the operation is made additionally difficult when the snowboarder is wearing heavy gloves or mittens because of the small size of the buckle, particularly the ribbed surface of the actuation member, and the relatively large pressure that must be applied against the spring bias in order to release the buckle.

A known binding release apparatus is ineffective for snowboard bindings of the type described above. U.S. Pat. No. 5,362,087, dated Nov. 8, 1994, discloses a complex binding release apparatus that utilizes a pair of binding straps that are formed as a unit to be latched and unlatched as a unit. A rigid connector plate connecting the free ends of the binding straps has a male latch member that is engagable with a female latch member on the board. A flexible cable extends upward from the female latch member through a guide member on the heel plate of the binding to a hip height so that the snowboarder can release the latch by pulling on the cable.

However, the prior binding release mechanism disclosed in U.S. Pat. No. 5,362,087 is ineffective for today's snowboard bindings whose binding straps are individually buckled and tightened according to the size of the snowboarder's boots. Moreover, the prior mechanism is not easily added to an existing binding of any type. The entire bindings must be replaced in order to provide a binding release apparatus according to this teaching.

SUMMARY OF THE INVENTION

It is therefore an object of the invention to provide a binding release mechanism for a snowboard, which is adaptable to binding straps that are individually latched and tightened. It is a further objection of the invention to provide such a binding release mechanism which is easily, quickly and safely actuated in both emergency and normal use. It is a still further object of the invention to provide a binding release mechanism that is easily and inexpensively retrofitted onto an existing snowboard binding without the need for any special tools.

The release mechanism of the invention is applicable to a snowboard having a snowboard binding means that includes a laterally spaced apart pair of binding straps. The binding straps are independently movable between (1) respective side-by-side laterally spaced apart latched positions over the vamp of the footwear (boot) at which the binding straps are in secure binding engagement with the vamp to securely retain the boot between the snowboard and the binding means, and (2) respective free positions in which the binding straps are freely movable relative to the snowboard and each other and permits ready movement of the boot away from the snowboard upper surface and removal of the boot from the snowboard and from the binding straps in a direction generally normal to the snowboard's upper surface.

The binding means to which the invention is applicable also includes two latch means, for example, a buckle or latch. Each latch means has an actuation member movable between an open position and a closed position. When the latch means is in the closed position the corresponding binding strap is releasably retained in the latched position. The latch means are responsive to respective forces on the actuation members in directions away from the upper surface of the snowboard to move the actuation members to the open positions, thereby to release the binding straps.

According to the invention, a release strap is provided. A connecting means connects the opposite ends of the release strap to the respective first and second latch means, so that by pulling on the release strap in a direction away from the snowboard upper surface, forces are applied to the actuation members of both first and second latch means so as to release both binding straps from the latched positions.

This can be done by the snowboarder while reaching down with one hand to grab hold of the release strap and pulling upward—a very simple matter, even when the snowboarder and the board are buried in deep snow.

In the preferred embodiments of the invention, each of the latch means includes elastic biasing means that biases the respective actuation member toward the closed position. The binding straps have serrations and the biasing means bias the respective actuation members toward engagement with the serrations to releasably hold the actuation members in their closed positions. Each latch means also includes a frame to which the actuation member is pivotally mounted. One end of each actuation member, as viewed in the radial direction with respect to the pivot axis, engages the binding strap to hold it in the closed position. The release strap is connected to that same end of the actuation member.

Both bindings are equipped in the same manner. To further facilitate easy release of the bindings, opposite ends of a connecting strap may be connected to the respective release straps between their opposite ends. By appropriate positioning of the ends of the connecting strap with respect to the ends of the release straps, it become possible to simultaneously release both binding straps of both bindings simply by pulling upward on the connecting strap.

BRIEF DESCRIPTION OF THE DRAWINGS

These and other aspects of the invention will be better understood from the following description of the preferred embodiments with reference to the drawings in which:

FIG. 7 is an enlarged perspective partial view of the binding shown in FIG. 3 showing the latch members in closed positions and retaining the binding straps;

FIG. 8 is an enlarged perspective partial view of the binding shown in FIG. 3 showing the latch members in open positions and binding straps withdrawn therefrom.

DETAILED DESCRIPTION OF THE PREFERRED EMBODIMENTS

Figure 1:
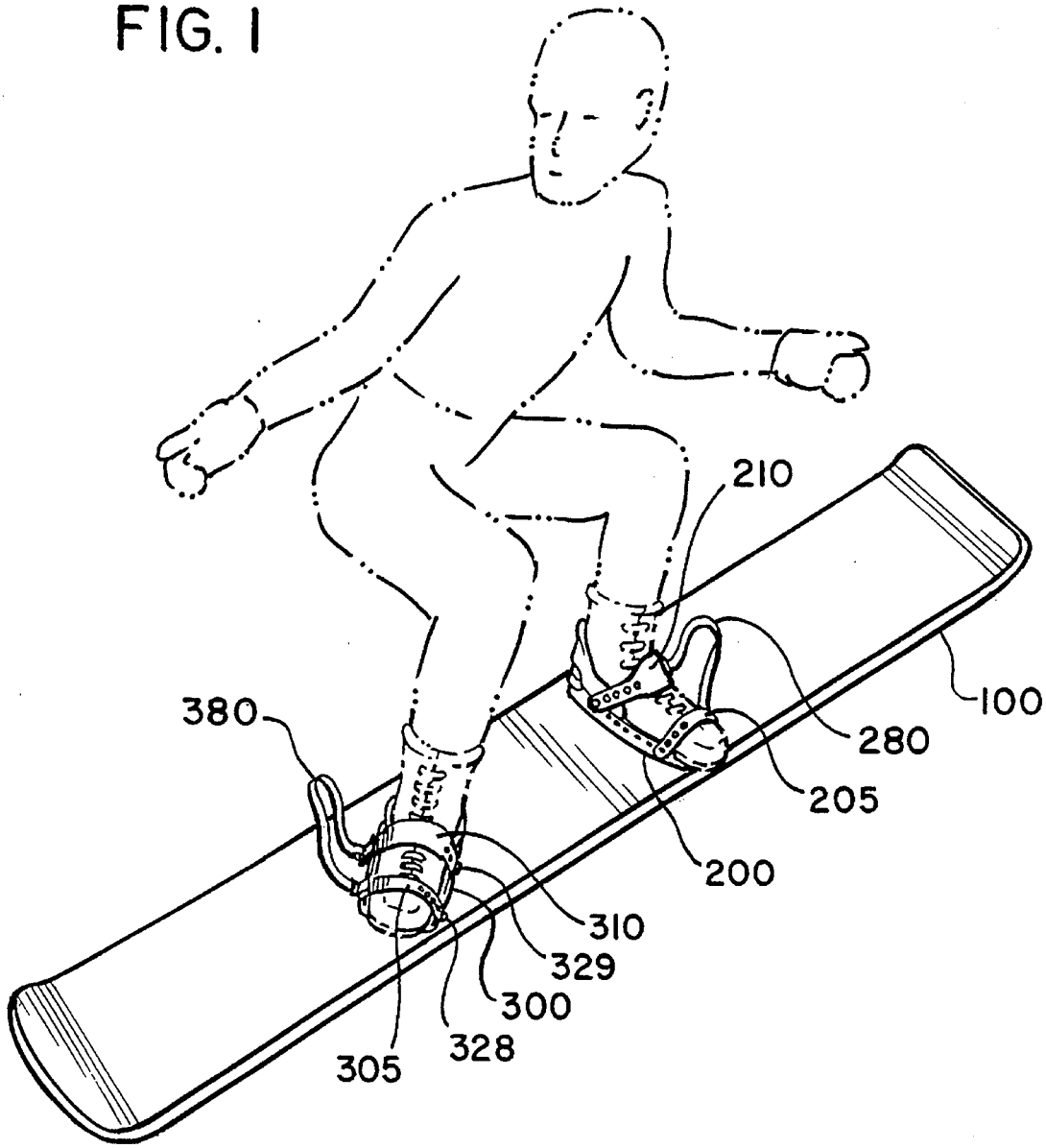
FIG. 1 is perspective view of a snowboard including a snowboard binding release mechanism according to the invention.

Referring first to FIG. 1, there is shown a snowboard 100 of conventional shape, including a first boot plate assembly 200, and a second bootplate assembly 300, respectively for supporting left and right footwear (e.g., boots) of a snowboard user. The orientations of the assemblies are adjustable, as is well known in the art, and are illustrated in positions with the assembly 200 (for the left foot) oriented transverse to the length of the board and the assembly 300 (for the right foot) oriented at 45° to the length. Each of the bootplate assemblies is provided with a pair of binding straps, that is, toe binding strap 205 and instep binding strap 210 on bootplate assembly 200 and toe binding strap 305 and instep binding strap 310 on bootplate assembly 300. Each of the binding straps is fixed to the one lateral side of the corresponding bootplate at one end and connected to the other lateral side of the bootplate by a corresponding latch or buckle, as will be explained in detail below.

Each of the bootplates is also provided with a release strap, that is, a release strap 280 for bootplate assembly 200 and a release strap 380 for bootplate assembly 300, for releasing each of the binding straps, as will also be explained in detail below.

Figure 3:
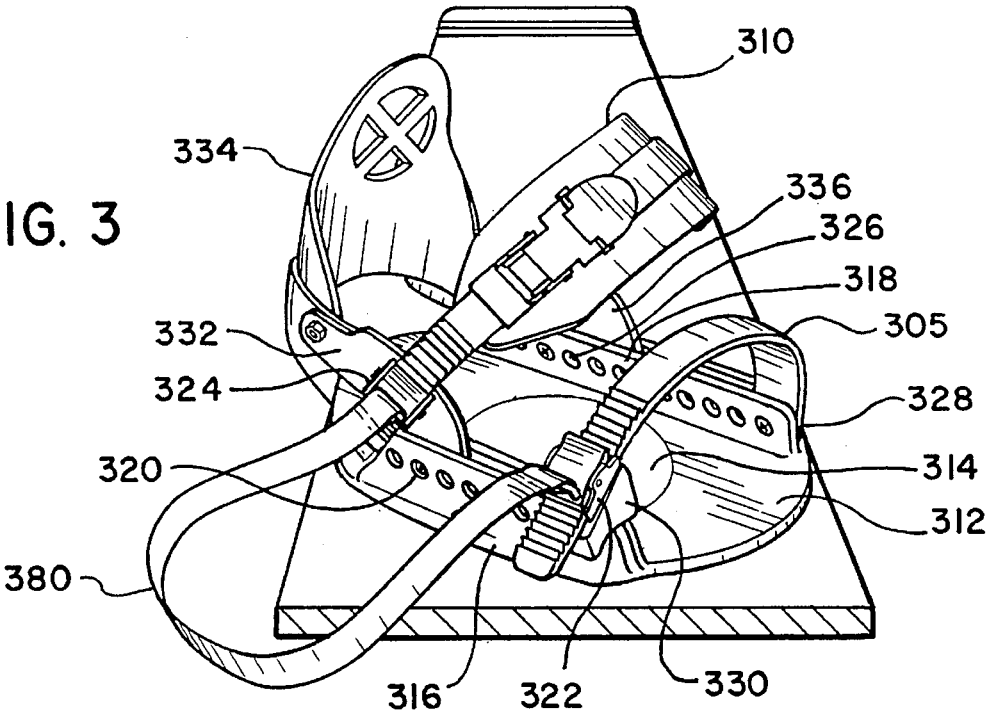
FIG. 3 is a cross-sectional view of a snowboard showing details of the binding for the right foot in FIG. 1, according to the invention.

Each of the bootplates 200 and 300 and binding straps 205, 210, 305 and 310 may be of conventional design. Referring to FIG. 3 which shows the right bootplate assembly 300, it includes a base portion 312 that is mounted to the board 100 with a circular center clamp 314, at any desired angle to the longitudinal direction of the board. The angle of the base portion 312 is set at about 45° in the illustrated embodiment. An outer sidewall 316 and an inner sidewall 318 bound the lateral inner and outer sides of the bootplate assembly, respectively. The outer sidewall 316 is provided with a series of holes 320 along its length for selective mounting of a toe binding strap latch or buckle 322 and an instep binding strap latch or buckle 324. The inner sidewall 318 is provided with a series of holes 326 for selective mounting of a proximal end 328 of the toe binding strap 305 and a proximal end 329 (see FIG. 1) of the instep binding strap 310, according to the size of the boot of the user, in a conventional manner. The toe binding strap latch 322 is mounted to the sidewall 316 by a mounting platform 330 in a conventional manner. The instep binding strap latch 324 is mounted to the sidewall 316 by a flap 332 connected between a heel support 334 and the sidewall 316 in a conventional manner. A similar flap 336, adjustably connected between the heel support 334 and the sidewall 318, is used to mount the proximal end 329 of the instep binding strap 310 to the sidewall 318.

The bootplate 200 and binding straps 205 and 210, for the left boot, are designed and arranged in a mirror image to those for the right boot. Therefore, for the sake of brevity, these elements for the left boot are not shown in detail in the drawings.

Figure 4:
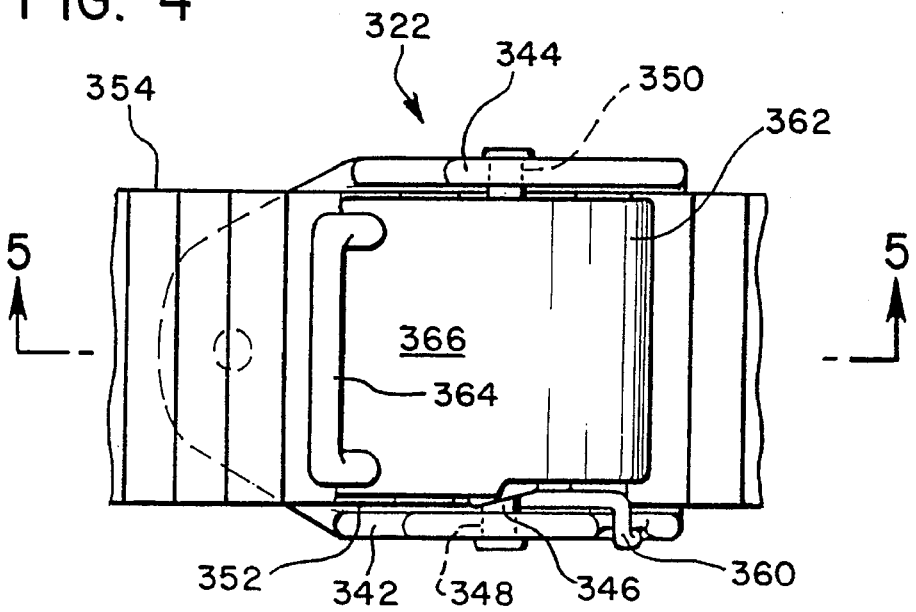
FIG. 4 is an enlarged plan view of the latch mechanism of FIG. 3.
Figure 5:
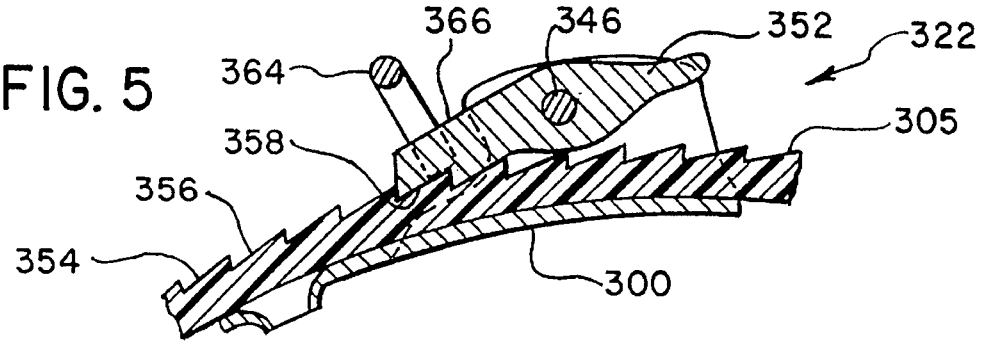
FIG. 5 is a cross-sectional view of the latch mechanism taken along line V—V in FIG. 4.
Figure 6:
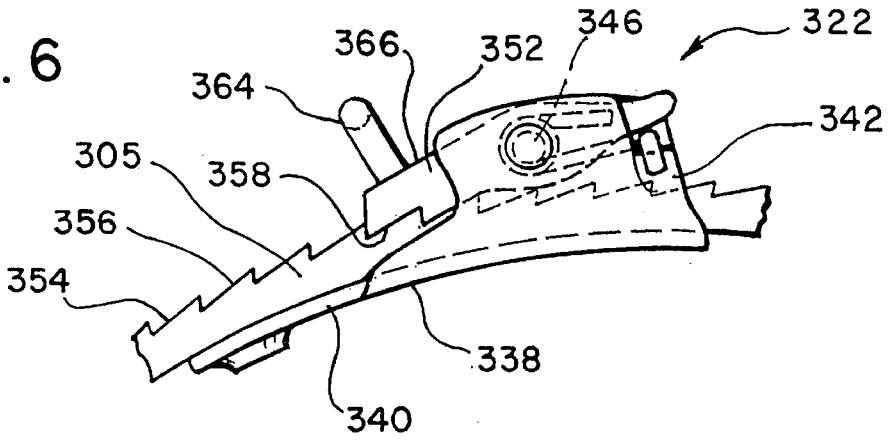
FIG. 6 is a side view of the latch mechanism shown in FIG. 4.

FIGS. 4, 5 and 6 show the toe binding strap latch 322 in detail. This latch is identical to toe binding strap latch 326 and to the corresponding latches for the left boot, and which are not shown in detail in the drawings for the sake of brevity. The latch 322 includes a frame member 338 having a bottom plate 340 and opposing lugs 342 and 344 on opposite sides, which support an axle 346 in holes 348 and 350. Pivotally mounted at its approximate center, on the axle 346, is an actuation member such as a latch lever 352. The axle 346 is positioned above the bottom plate 340 by such a distance that the distal end 354 of the toe binding strap 305 can be slid along the bottom plate 340, under the latch lever 352 and axle 346. At and near the distal end 354, the binding strap 305 on an upper surface thereof is provided with serrations 356. An end of latch lever 352 has serrations 358 matching those on the binding strap 305. A coil spring 360 biases the latch lever 352 in a counterclockwise direction in FIG. 5 toward engagement of the latch lever's serrations 358 with those on the binding strap 305. Thus, when the binding strap 305 is inserted between the latch lever 352 and the bottom plate 340, the latch lever 352, due to the angle of the serrations 356 and 358, is automatically pivoted in a clockwise direction allowing further insertion of the binding strap 305 in a right-to-left direction in FIG. 5. However, when no force or only a left-to-right lateral force is applied to the binding strap 305, the serrations remain engaged, again due to the angle of the serrations, thereby blocking any movement of the binding strap 305 with respect to the latch 322.

Figure 9:
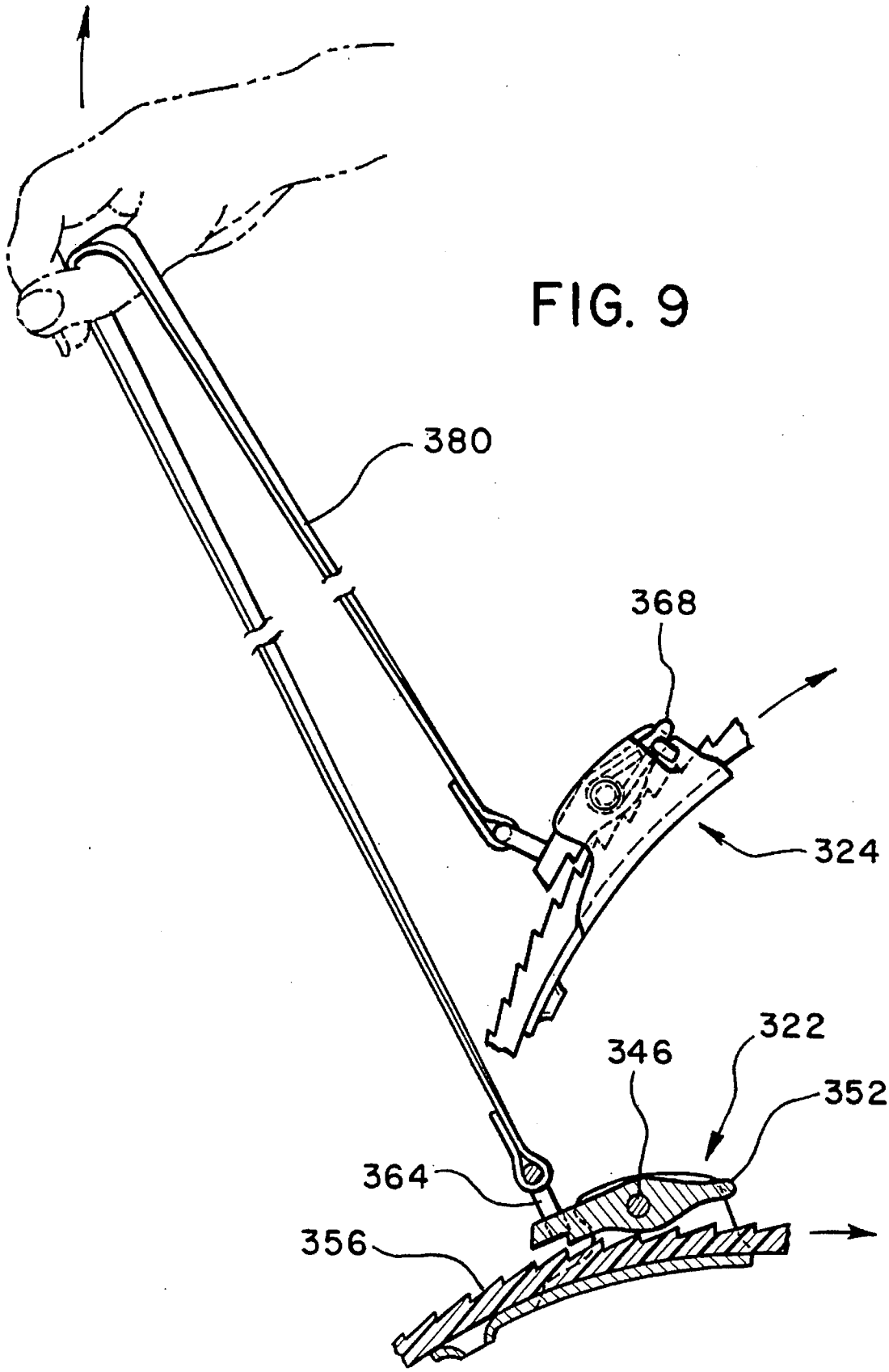
FIG. 9 is an enlarged partial side view, partly in cross-section, of the binding shown in FIG. 3 showing the latch members held open positions by pulling upward on the release strap.

In order to release the binding strap 305 from the latch 322, there are provided two means for pivoting the latch lever 352 in a clockwise direction. One means, which is conventional, is a ribbed upper surface 362 of the right side of the latch lever 352. The ribbed surface 362 facilitates release of the binding strap 305 by pushing down on the ribbed surface with a finger. The other means, according to the invention, includes a loop-shaped connecting member 364 that projects from the upper surface 366 of the left side of the latch lever 352. The connecting member 364 serves to connect the latch lever 352 to one end of the binding release strap 380, as is explained below with reference to FIGS. 7–9.

As shown in FIG. 7, the release strap 380 is connected at its other end to the loop connector 367 on the latch lever 368 of the instep binding strap latch 324. When the binding strap latches 322 and 324 are at rest, they secure the distal ends of the binding straps in place as shown in FIG. 7. Thus, by pulling upward on the release strap 380, as shown in FIG. 8, both latch levers 352 and 368 are pivoted to release both binding straps. Therefore, by lifting his right foot, the snowboard user can easily withdrawn his foot from the binding as both of the binding straps 305 and 310 offer little resistance and move easily to the right in FIG. 8, out of the latches 322 and 324. The action of the release strap to open the latches is even more clearly visible in FIG. 9, which shows that by upward vertical movement of the release strap, the latch levers 352 and 368 are pivoted in a clockwise direction to disengage the serrations of the latch levers from those of the binding straps.

The present invention is easily obtained not only on a new snowboard binding, but also by retrofitting an existing conventional snowboard. Retrofitting an existing binding to produce one according to the invention, may require only that existing latches, not bearing a release strap or means for connecting it, be replaced with latches having such means. Then, a suitable binding release strap is easily connected between the connecting means to obtain a snowboard binding release apparatus according to the invention. Normally, this can be easily accomplished since the latches can be connected and disconnected, typically with only a screwdriver.

Figure 2:
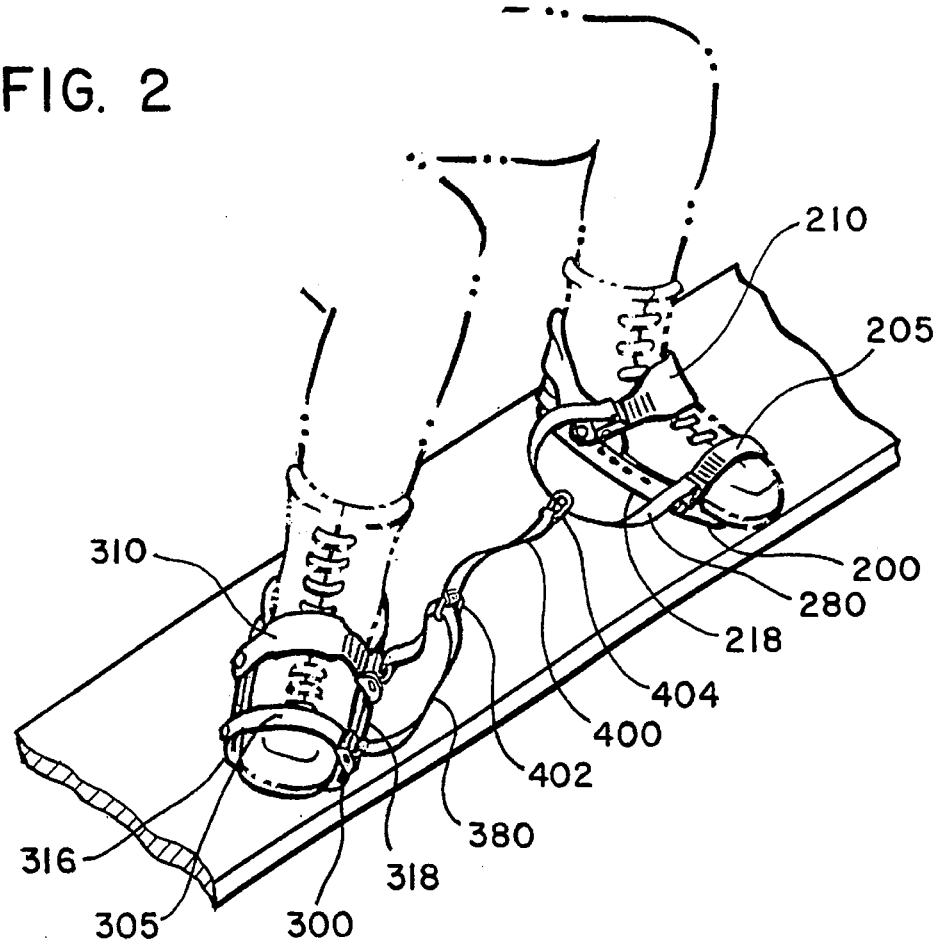
FIG. 2 is a partial perspective view of a snowboard including a snowboard binding release mechanism according to another embodiment of the invention.

FIG. 2 shows another embodiment of the invention in which the binding straps and binding strap latches are reversed, so that the latches and release straps are disposed at the facing inner sidewalls 318 and 218 of the respective bootplates 300 and 200, rather than at their outer sidewalls as in the previously described embodiment. To further facilitate easy release of the bindings, a connecting strap 400 is connected at its opposite ends 402 and 404 to the respective release straps 380 and 280 between the latter's' opposite ends. By positioning the ends of the connecting strap 400 appropriately with respect to the end of the release straps 380 and 280, it becomes possible to simultaneously release both binding straps 305, 310 and 205, 210 of the two bindings, simply by pulling upward on the connecting strap 400.

It is understood that although the invention has been described in detail with respect to preferred embodiments thereof, the invention is not limited thereto. Other embodiments and variations which fall within the scope and spirit of the invention will be apparent to those skilled in the art, the invention being limited only by the following claims.

What is claimed is:

1. A binding latch and release device for use with a binding structure for a snowboard, the binding structure for use in binding to an upper surface of the snowboard footwear of a person employing the snowboard and including a base having opposite first and second sides and means for fixing the base to the snowboard, and a laterally spaced apart pair of first and second binding straps, the binding straps having proximal ends connected to the first side of the base and an opposite distal end, the binding latch and release device comprising:

first and second latch means, each having an actuation member movable between an open position and a closed position, the first and second latch means being adapted to respectively releasably retain the distal ends of the binding straps in latched positions when the actuation member is in the closed position, the first and second latch means being responsive to respective forces on the actuation members thereof in directions away from the snowboard upper surface to move the actuation members to the open positions, thereby being adapted to release the distal ends of the binding straps from the latched positions; and a release strap having opposite ends connected to the respective actuation members, so that by pulling on the release strap in the directions away from the snowboard upper surface, the respective forces are applied to the actuation members of the first and second latch means to move the actuation members to the open position thereby being adapted to release the distal ends of the binding straps from the latched positions.

2. A binding latch and release device according to claim 1, further comprising hoops fixed to said actuation members, said opposite ends of said release strap being connected to said actuation members by said hoops.

3. A binding apparatus for use with a snowboard, comprising:

snowboard binding means for binding to an upper surface of the snowboard footwear of a person employing the snowboard, including a laterally spaced apart pair of first and second binding straps, the binding straps being independently movable between (1) respective side-by-side laterally spaced apart latched positions over the vamp of the footwear at which the straps are in secure binding engagement with the vamp to securely retain the footwear between the snowboard and the binding means, and (2) respective free positions in which the straps are freely movable relative to the snowboard and each other and permit ready movement of the footwear away from the snowboard upper surface and removal of the footwear from the snowboard and from the binding straps, in a direction generally normal to the snowboard upper surface, and first and second latch means, each having an actuation member movable between an open position and a closed position, the first and second latch means respectively releasably retaining the first and second binding straps in the latched positions when the actuation member is in the closed position, the first and second latch means being responsive to respective forces on the actuation members in directions away from the snowboard upper surface to move the actuation members to the open positions, thereby to release the binding straps from the latched positions;

a release strap having opposite ends; and connecting means, connecting the opposite ends of the release strap to the respective first and second latch means, so that by pulling on the strap in the directions away from the snowboard upper surface, the respective forces are applied to the actuation members of the first and second latch means so as to release the binding straps from the latched positions.

4. A binding apparatus according to claim 3, wherein each of the latch means includes elastic biasing means that bias the respective actuation member toward the closed position.

5. A binding apparatus according to claim 4, wherein the binding straps have serrations and the biasing means bias the respective actuation members toward engagement with the serrations.

6. A binding apparatus according to claim 4, wherein each of the first and second latch means further comprises a frame and means pivotally mounting a respective one of the actuation members to the frame so as to be pivotable about an axis, the actuation member having opposite first and second ends on opposite radial sides of the axis, the first end having a first side that engages the binding strap in the closed position and a second side opposite the first side bearing the connecting means.

7. A binding apparatus according to claim 3, wherein the binding straps have serrations and the actuation members engage with the serrations in the closed position.

8. A snowboard, comprising a board having an upper surface;

first and second spaced apart snowboard binding means, mounted to the upper surface for binding to the upper surface first and second footwear of a person employing the snowboard, each of the first and second binding means including a laterally spaced apart pair of first and second binding straps, the binding straps being independently movable between (1) respective side-by-side laterally spaced apart latched positions over the vamp of the footwear, at which the straps are in secure binding engagement with the vamp to securely retain the footwear between the snowboard and the binding means, and (2) respective free positions in which the straps are freely movable relative to the snowboard and each other and permit ready movement of the footwear away from the snowboard upper surface and removal of the footwear from the snowboard and from the straps, in a direction generally normal to the snowboard upper surface, and first and second latch means, each having an actuation member movable between an open position and a closed position, the first and second latch means respectively releasably retaining the first and second binding straps in the latched positions when the actuation member is in the closed position, the first and second latch means being responsive to respective forces on the actuation members in directions away from the snowboard upper surface to move the actuation members to the open positions, thereby to release the binding straps from the latched positions;

first and second release straps, each having opposite ends;

first connecting means, connecting the opposite ends of the first release strap to the respective first and second latch means of the first binding means, so that by pulling on the first release strap in the directions away from the snowboard upper surface, the respective forces are applied to the actuation members of the first and second latch means of the first binding means, so as to release the binding straps of the first binding means from the latched positions;

second connecting means, connecting the opposite ends of the second release strap to the respective first and second latch means of the second binding means, so that by pulling on the second release strap in the directions away from the snowboard upper surface, the respective forces are applied to the actuation members of the first and second latch means of the second binding means, so as to release the binding straps of the second binding means from the latched positions; and a connecting strap having opposite ends connected to the respective first and second release straps between the opposite ends thereof at such positions that by pulling upward on the connecting strap, the first and second binding straps of both of the first and second binding means are simultaneously released.

* * * * *